US006789871B2

(12) United States Patent
Edelen et al.

(10) Patent No.: US 6,789,871 B2
(45) Date of Patent: Sep. 14, 2004

(54) REDUCED SIZE INKJET PRINTHEAD HEATER CHIP HAVING INTEGRAL VOLTAGE REGULATOR AND REGULATING CAPACITORS

(75) Inventors: John Glenn Edelen, Versailles, KY (US); George Keith Parish, Winchester, KY (US); Kristi Maggard Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 22 days.

(21) Appl. No.: 10/331,001

(22) Filed: Dec. 27, 2002

(65) Prior Publication Data

US 2004/0125157 A1 Jul. 1, 2004

(51) Int. Cl.[7] ..... B41J 29/393; B41J 29/38; B41J 2/205

(52) U.S. Cl. ..... 347/19; 347/17; 347/14

(58) Field of Search ..... 347/19, 17, 67, 347/18, 60, 62, 9, 61, 10, 64, 12, 63, 43, 15, 81, 76, 5, 58, 59, 14, 20, 23, 50; 257/464, 467; 438/376

(56) References Cited

U.S. PATENT DOCUMENTS

| | | | | |
|---|---|---|---|---|
| 4,835,549 A | | 5/1989 | Samejima | |
| 5,300,968 A | | 4/1994 | Hawkins | |
| 5,371,530 A | | 12/1994 | Hawkins | |
| 5,517,053 A | | 5/1996 | Dietz et al. | |
| 5,734,392 A | | 3/1998 | Cornell | |
| 5,736,997 A | | 4/1998 | Bolash et al. | |
| 5,742,307 A | | 4/1998 | Watrobski et al. | |
| 5,850,242 A | | 12/1998 | Asaba | |
| 5,933,161 A | | 8/1999 | Sato | |
| 6,081,280 A | | 6/2000 | Bolash et al. | |
| 6,234,612 B1 | | 5/2001 | Cornell et al. | |
| 6,302,504 B1 | | 10/2001 | Imanaka | |
| 6,409,298 B1 | | 6/2002 | Ahne et al. | |
| 6,431,677 B1 | | 8/2002 | Anderson et al. | |
| 6,439,680 B1 | | 8/2002 | Mochizuki et al. | |
| 6,499,821 B1 | * | 12/2002 | Nozawa | 347/14 |
| 6,616,268 B2 | * | 9/2003 | Parish | 347/58 |

* cited by examiner

*Primary Examiner*—Stephen D. Meier
*Assistant Examiner*—Charles Stewart, Jr.
(74) *Attorney, Agent, or Firm*—King & Schickli, PLLC

(57) ABSTRACT

An inkjet printhead heater chip has an integral voltage regulator that derives two output voltages from a single chip input voltage. One of the two output voltages powers control logic circuitry as the other powers FET drivers. Preferred output voltages include +3.3 volts for the control logic circuitry and +7.5 volts for the FET drivers. A Vgs of the FET is about +7.5 volts which enables a FET area width of about 400 microns. Outputs of the control logic circuitry provide input to the FET drivers. A resistive heater for ejecting ink couples between a drain of the FET and the chip input voltage. Voltage regulating capacitors exist on the heater chip in parallel with the input voltage and each of the output voltages. Preferred capacitors have a gate oxide and a polysilicon layer overlying a substrate. Inkjet printers for housing the printheads are also disclosed.

29 Claims, 7 Drawing Sheets

REDUCED SIZE INKJET PRINTHEAD HEATER CHIP HAVING INTEGRAL VOLTAGE REGULATOR AND REGULATING CAPACITORS

FIELD OF THE INVENTION

The present invention relates to inkjet printheads. In particular, it relates to a heater chip thereof having reduced size due to narrowed-width power FETs driven by an integral voltage regulator with regulating capacitors.

BACKGROUND OF THE INVENTION

The art of printing images with inkjet technology is relatively well known. In general, an image is produced by emitting ink drops from an inkjet printhead at precise moments such that they impact a print medium at a desired location. The printhead is supported by a movable print carriage within a device, such as an inkjet printer, and is caused to reciprocate relative to an advancing print medium and emit ink drops at such times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, to name a few.

Conventionally, a thermal inkjet printhead includes access to a local or remote supply of color or mono ink, a heater chip, a nozzle or orifice plate attached to the heater chip, and an input/output connector, such as a tape automated bond (TAB) circuit, for electrically connecting the heater chip to the printer during use. The heater chip, in turn, typically includes a plurality of thin film resistors or heaters fabricated by deposition, masking and etching techniques on a substrate such as silicon.

To print or emit a single drop of ink, an individual resistive heater is uniquely addressed with a small amount of current to rapidly heat a small volume of ink. This causes the ink to vaporize in a local ink chamber (between the heater and nozzle plate) and be ejected through and projected by the nozzle plate towards the print medium.

The circuitry that drives the printing of a single ink drop typically includes a source of a field effect transistor (FET) and a voltage source (+10.8 volts is common) coupled to either ends of the resistive heater. Control logic circuitry sends logic signals to a gate of the FET and, upon actuation of the FET, the resistive heater heats and ink is ejected.

As a natural occurrence of powering transistor-transistor logic (TTL) devices of the control logic circuitry with +5 volts, many FETs are driven with the same voltage. With present day CMOS ASICs, however, the voltage standard for control logic is +3.3 volts. Thus, if a heater chip of an inkjet printer is to power its CMOS with one voltage and drive its FET with another voltage, while providing powering voltage of its resistive heaters with still another voltage, at least three different voltages need to be conveyed from the printer to the heater chip and must, in turn, be laid out (wired) feasibly on the chip. This, however, adds circuit cost and complexity.

Accordingly, the inkjet printhead arts desire heater chips having optimum voltage control without attendant chip expense.

SUMMARY OF THE INVENTION

The above-mentioned and other problems become solved by applying the apparatus and method principles and teachings associated with the hereinafter described inkjet printhead heater chip having reduced size.

In one embodiment, the heater chip has an integral voltage regulator that derives two output voltages from a single voltage input to the chip. One of the two output voltages powers control logic circuitry while the other powers FET drivers. Preferably, the input voltage includes +10.8 volts and the output voltages include lines of +3.3 volts for the control logic circuitry and +7.5 volts for the FET drivers. A Vgs of the FET is about +7.5 volts which enables a FET area width of about 400 microns and an area length of about 42 microns ($1/600^{th}$ inch). Outputs of the control circuitry provide input to the FET drivers. A resistive heater for ejecting ink couples between a drain of the FET and the chip input voltage. Preferred FET drivers include logic AND gates or logic NAND gates with an inverter.

In another aspect of the invention, voltage regulating capacitors exist on the heater chip in parallel with either or all of the input voltage and each of the output voltages. Preferred capacitors have a gate oxide and a polysilicon layer overlying a substrate and may or may not have a region of n-well doping within the substrate beneath the gate oxide. The positive capacitor electrode attaches to the polysilicon layer. The negative capacitor electrode attaches to an electrically grounded substrate.

Printheads containing the heater chip and printers containing the printhead are also disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the invention may be practiced. These embodiments are described in sufficient detail to enable those skilled in the art to practice the invention and it is to be understood that other embodiments may be utilized with various process, electrical, mechanical, chemical, or other changes without departing from the scope of the present invention. The following detailed description is, therefore, not to be taken in a limiting sense and the scope of the present invention is defined only by the appended claims and their equivalents.

In accordance with the present invention, we hereinafter describe an inkjet printhead heater chip having a reduced size due to narrowed-width power FETs driven by an integral voltage regulator with regulating capacitors.

Figure 1:
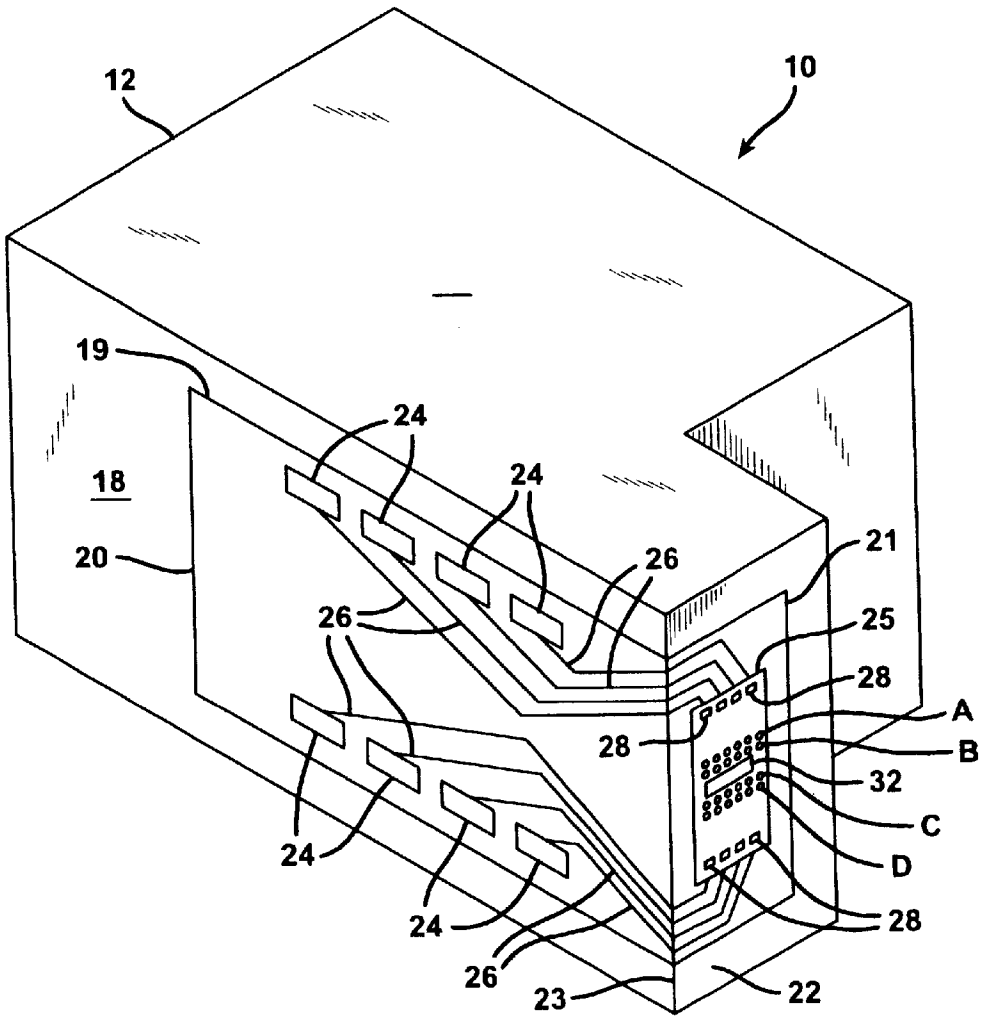
FIG. 1 is a perspective view in accordance with the teachings of the present invention of a thermal inkjet printhead.

With reference to FIG. 1, an inkjet printhead of the present invention is shown generally as 10. The printhead 10 has a housing 12 formed of any suitable material for holding ink. Its shape can vary and often depends upon the external device that carries or contains the printhead. The housing has at least one compartment 16 internal thereto for holding an initial or refillable supply of ink. In one embodiment, the compartment has a single chamber and holds a supply of black ink, photo ink, cyan ink, magenta ink or yellow ink. In other embodiments, the compartment has multiple chambers and contains three supplies of ink. Preferably, it includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply from a tube, for example.

Adhered to one surface 18 of the housing 12 is a portion 19 of a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 thereon for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Various techniques are known for facilitating such connections. For simplicity, we have only showed eight I/O connectors 24, eight electrical conductors 26 and eight bond pads 28 but present day printheads have much larger quantities and any number is equally embraced herein. Still further, those skilled in the art should appreciate that while such number of connectors, conductors and bond pads equal one another, actual printheads may have unequal numbers.

The heater chip 25 contains four rows (rows A-row D) of a plurality of resistive heater elements (or heaters for short) that serve to eject ink from compartment 16, during use. For simplicity, the pluralities of heaters in rows A through D are shown as rows of six dots but in practice may include hundreds of heaters spaced every $1/600^{th}$, $1/1200^{th}$, $1/2400^{th}$ or other of an inch along the length of the via. To form the vias, many processes are known and include grit blasting or etching, such as wet, dry, reactive-ion-etching, deep reactive-ion-etching, or other. A nozzle plate (not shown) has orifices thereof aligned with each of the heaters to project the ink during use. The nozzle plate may attach with an adhesive or epoxy or may be fabricated as a thin-film layer.

Figure 2:
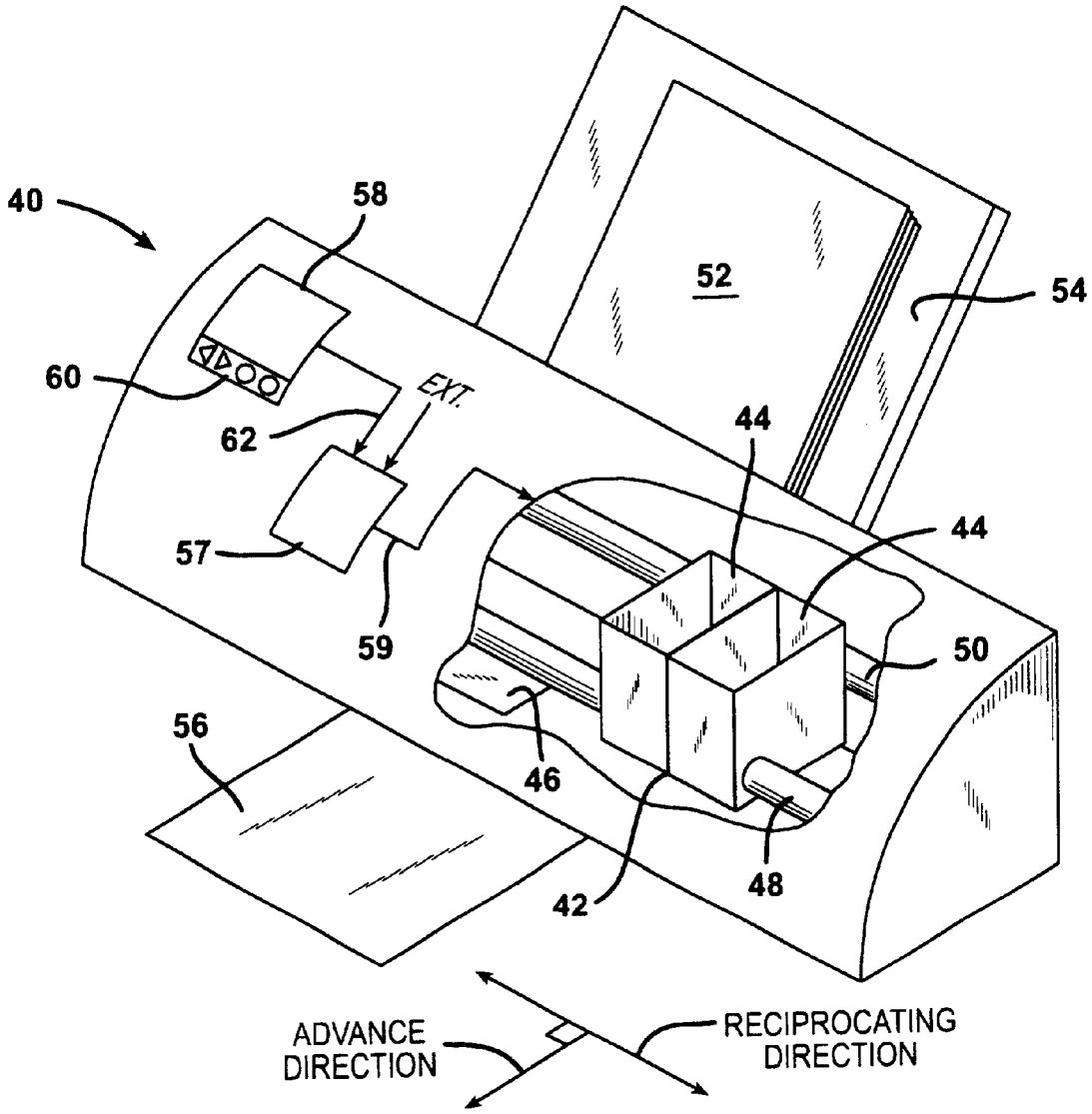
FIG. 2 is a perspective view in accordance with the teachings of the present invention of an inkjet printer.

With reference to FIG. 2, an external device in the form of an inkjet printer for containing the printhead 10 is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50 as is well known in the art. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be eject from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer and include, but are not limited to, a computer, a scanner, a camera, a visual display unit, a personal data assistant, or other.

To print or emit a single drop of ink, the heaters (the dots of rows A–D, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such an ink drop may embody a single or a split firing pulse.

A control panel 58 having user selection interface 60 also accompanies many printers, as an input 62 to the controller 57, to provide additional printer capabilities and robustness.

Figure 3:
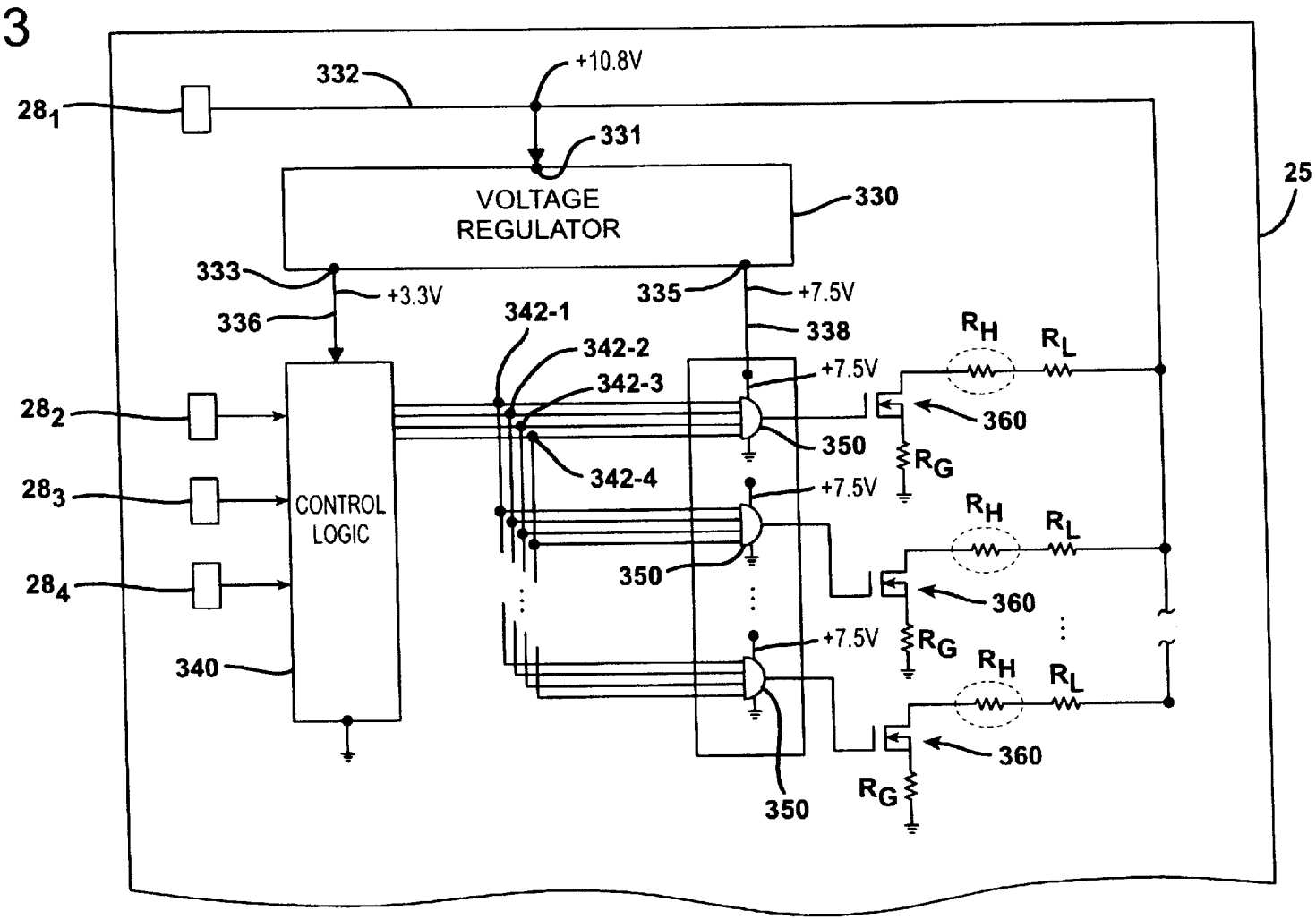
FIG. 3 is a diagrammatic view in accordance with the teachings of the present invention of a circuit enabling a narrow-sized power FET in a heater chip of an inkjet printhead.
Figure 5:
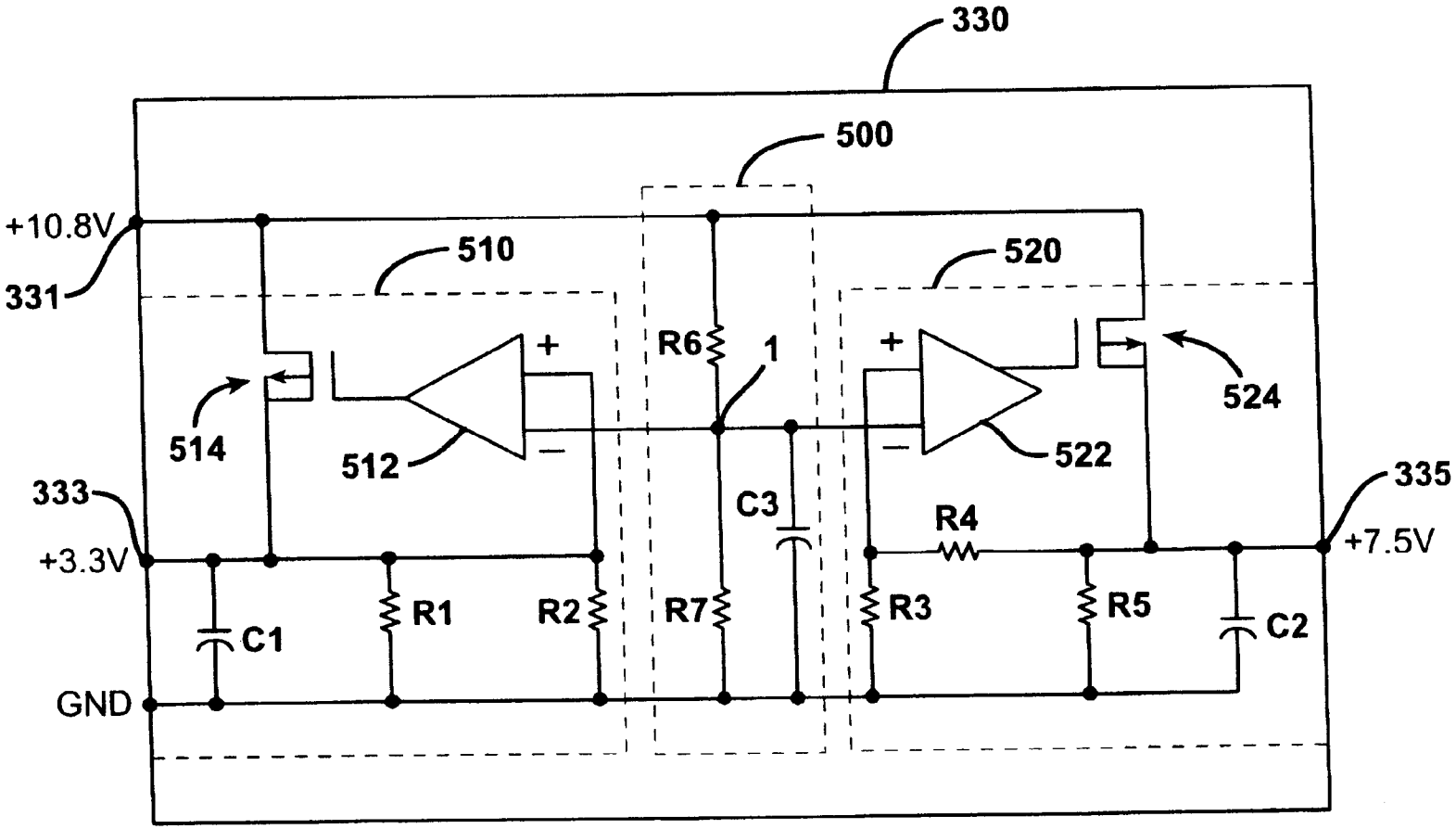
FIG. 5 is a diagrammatic view in accordance with the teachings of the present invention of an integral voltage regulator.

With reference to FIG. 3, a reduced size heater chip 25 of the present invention has an integral voltage regulator 330. An input terminal, such as a bond pad $\mathbf{28}_1$, supplies the heater chip with a single input voltage, preferably +10.8 volts. An input voltage line 332 connects to the input terminal to provide an electrical path for the input voltage to be supplied to the voltage regulator at node 331. During use, the voltage regulator derives at least two output voltages, supplied at nodes 333, 335, from the single input voltage. Preferably, the +10.8 volt input becomes about +3.3 volts on output voltage signal line 336 and about +7.5 volts on output voltage signal line 338. FIG. 5, described below, shows one embodiment of a voltage regulator for use with this invention.

A control logic circuit 340 receives logic inputs from input terminal bond pads $\mathbf{28}_2$, $\mathbf{28}_3$, $\mathbf{28}_4$, in turn, electrically connected to the printer. Outputs of the control logic circuit (four representative outputs shown as 342-1, 342-2, 342-3, 342-4) couple as inputs to pluralities of drivers 350 that activate, or not, switches 360. As shown, the switches embody power FETs having a gate coupled to an output of the driver 350, a source coupled to a ground path resistor $R_G$, and a drain coupled to a resistive heater element $R_H$ that acts to heat and eject ink through nozzle orifices (dashed lines) upon activation of the switch to which they are coupled. Because other resistance may exist in the path between the input terminal and the resistive heater elements $R_H$, an additional resistance is shown electrically there between as $R_L$.

In a preferred embodiment, the outputs 342 of the control logic circuit include a primitive, an address and an extended address line for addressing particular drivers 350 and a firing pulse line. In other embodiments, these lines may include more, fewer or other signals.

Regarding voltage powering of the control logic circuit 340, the drivers 350 and the resistive heater elements $R_H$, the first and second output voltage lines 336, 338 of the voltage regulator 330 supply voltages to the control logic circuit and the drivers, respectively, while the input voltage from input terminal 28, supplies voltage to the resistive heaters. In this manner, the control logic circuit can receive one voltage for CMOS-based logic devices and the drivers can simultaneously receive another voltage while only one voltage is supplied to the heater chip. In a preferred embodiment, the voltage on line 336 is about +3.3 volts while the voltage on line 338 is about +7.5 volts. Thereafter, when an output of any individual driver 350 activates its corresponding FET, a Vgs (gate to source voltage) of the FET can become as large as about +7.5 volts.

With reference to the following Table, skilled artisans will notice that the resistance (RFET) of a 400 micron wide FET area with a Vgs of about +7.5 volts equates to the same resistance of a prior art 500 micron wide FET area with a Vgs of about +5 volts.

TABLE

Measured Characteristics of 400 and 500 micron wide FET areas and 42 micron FET area length at Room Temperature and 320 mA Rated Current

| Vgs (Volts) | RFET (Ω) | FET Area Width (microns) |
|---|---|---|
| 3.3 | 7.0 | 500 |
| 5 | 4.5 | 500 |
| 7.5 | 4.0 | 500 |
| 3.3 | 8.0 | 400 |
| 5 | 4.9 | 400 |
| 7.5 | 4.5 | 400 |

Figure 4:
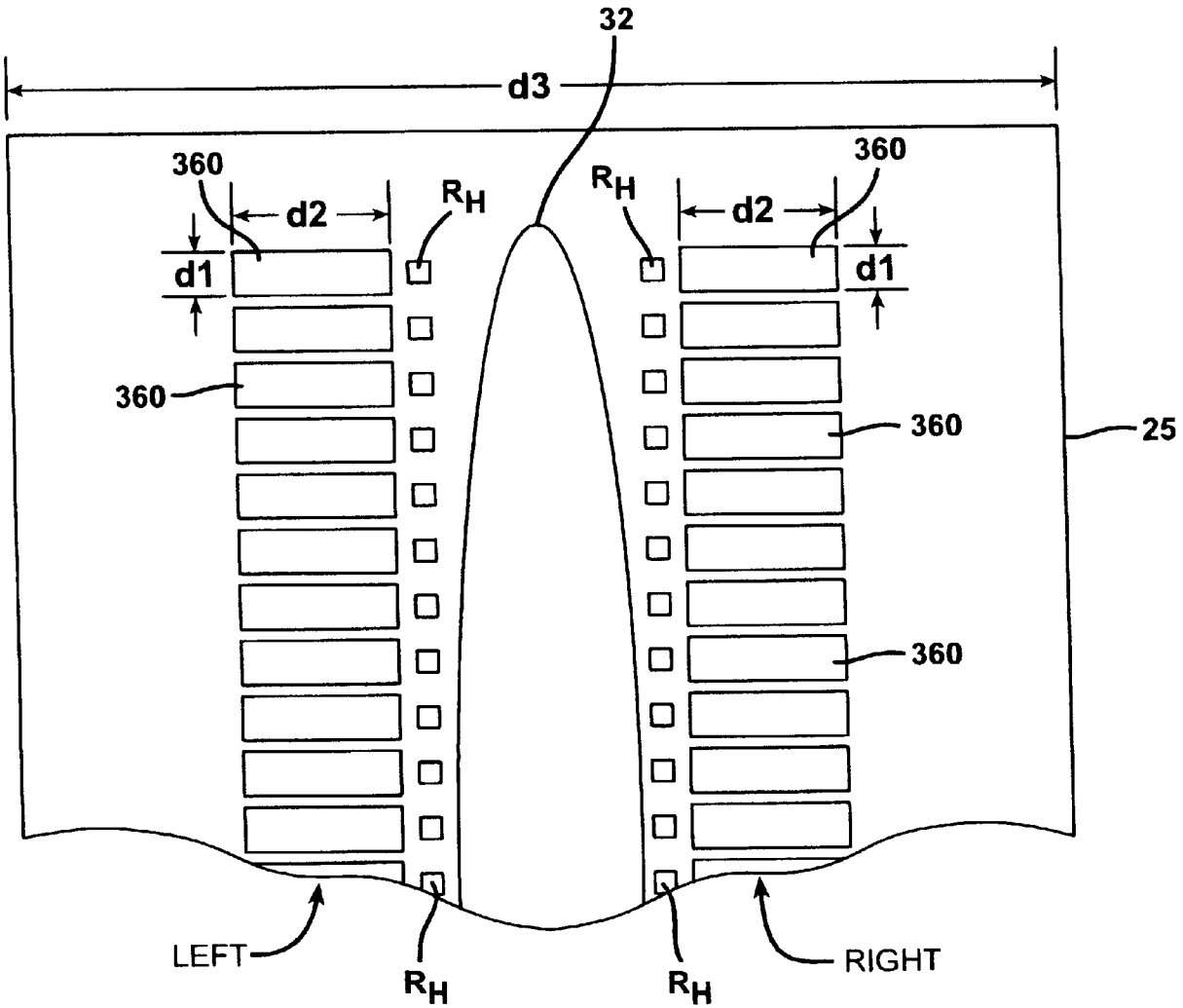
FIG. 4 is a diagrammatic view in accordance with the teachings of the present invention of a portion of a reduced size heater chip having narrow-sized power FETs.

Accordingly, with reference to FIG. 4, since a FET width d2 can decrease with an increase in Vgs and still maintain a drain current suitable for firing ink from a resistive heater element, the overall width d3 of the heater chip can correspondingly decrease. This saves silicon costs. As representation of silicon savings, one actual wafer production of a plurality of heater chips having the above decrease in FET width corresponded to about a six percent increase in dies-per-wafer from 199 to 212.

Since the heater chip shown embodies a single via 32 with left and right rows of FETs each narrowing from 500 to 400 microns, the distance d3 of the heater chip can correspondingly narrow by about 200 microns. Even further, if the heater chip has multiple vias and multiple left and/or right rows of power FETs, the width of the heater chip can narrow by even more distance.

As still other evidence of improvement over the prior art, since the input terminals of the heater chip now only need one input voltage, the TAB circuit 20 can have a corresponding decrease in conductors and/or I/O connectors and the printer need only provide for a single instance of input voltage.

Regarding the distance d1 between adjacent ones of FETs, this value preferably corresponds to the vertical pitch distance between resistive heater elements. As such, since pitch typically corresponds to printer resolution in dots-per-inch (DPI), the invention contemplates distances of $1/600^{th}$ of an inch $1/300^{th}$, $1/1200^{th}$, $1/2400^{th}$ or other.

With reference to FIG. 5, one embodiment of an integral or on-chip voltage regulator 330 includes three sub-circuits, especially a voltage reference circuit 500 and first and second regulator circuits 510, 520 for deriving first and second output voltages (+3.3 and +7.5 volts) from an input voltage (+10.8 volt, in the following example).

In general, the voltage reference circuit 500 comprises a voltage divider consisting of a pair of resistors R6, R7 in series. The ratio of the two resistors is selected to achieve a desired reference voltage at a node 1 between them. In a preferred embodiment, R6 is a 150 K ohm resistor, R7 is a 66 K ohm resistor and since the input voltage is about 10.8 volts, a reference voltage of about 3.3 volts is achieved. Additionally, a capacitor C3 may be provided to assist in stabilizing the voltage. One preferred C3 value is 200 pF.

Regarding the regulator circuit 510, it comprises an op-amp 512 with its inverting input (−) connected to the reference voltage node 1. The non-inverting input (+) connects to a drain of a pmos transistor 514. During use, the pmos transistor acts as a pass device between the input voltage at node 331 and the output voltage at node 333. By setting the feedback resistor R2 to some large value (100 K ohms in one embodiment) and having no resistance in the path between the non-inverting input (−) of the op-amp and node 333, the op-amp 4 becomes configured for a unity gain. As such, in this configuration the op-amp will vary the voltage at the output of op-amp 512 in order to hold the voltage at node 333 to be the same value as the inverting input (−), namely 3.3 volts. Resistor R1 (13.2 k ohms in one embodiment) is used to force a constant 250 A of current through the pass device 514 to aid stability. The capacitance C1 (preferably 2 nF) at the output node 333 of the regulator circuit 510 provides additional circuit stability.

The regulator circuit 520 is similar to regulator circuit 510 except that a resistor R4 (125 K ohm) is added between the non-inverting input (−) of the op-amp 522 and a drain of the pass device 524. In turn, amplifier gain increases such that an output of the op-amp 522 attempts to hold the voltage at node 335 at a constant 7.5 volts. The value of the loading resistor R5 (30 K ohm) has also been modified to provide the same constant 250 A of current flow.

Figure 6:
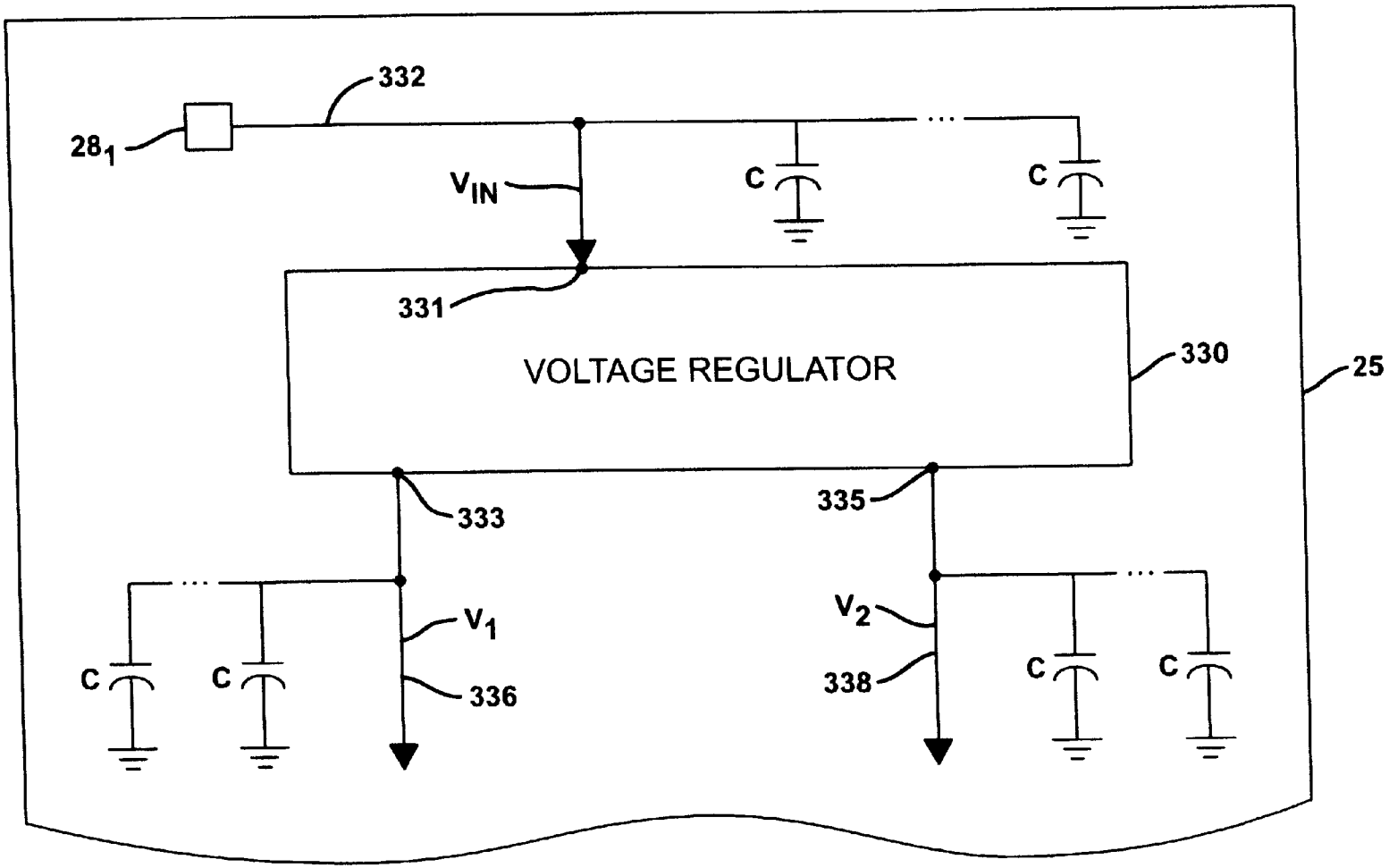
FIG. 6 is a diagrammatic view in accordance with the teachings of the present invention of a heater chip having pluralities of voltage regulating capacitors.

As shown with reference to FIG. 6, to ensure relatively smooth voltage waveforms on the heater chip, pluralities of capacitors C become placed in electric parallel with the input voltage Vin on line 332 and the output voltages V1, V2, on lines 336, 338. In a preferred embodiment, about 10 to 15 total capacitors exist on the heater chip 25 for each of the input Vin and output voltages V1, V2 and are dispersed about an entirety of the heater chip.

Figure 7A:
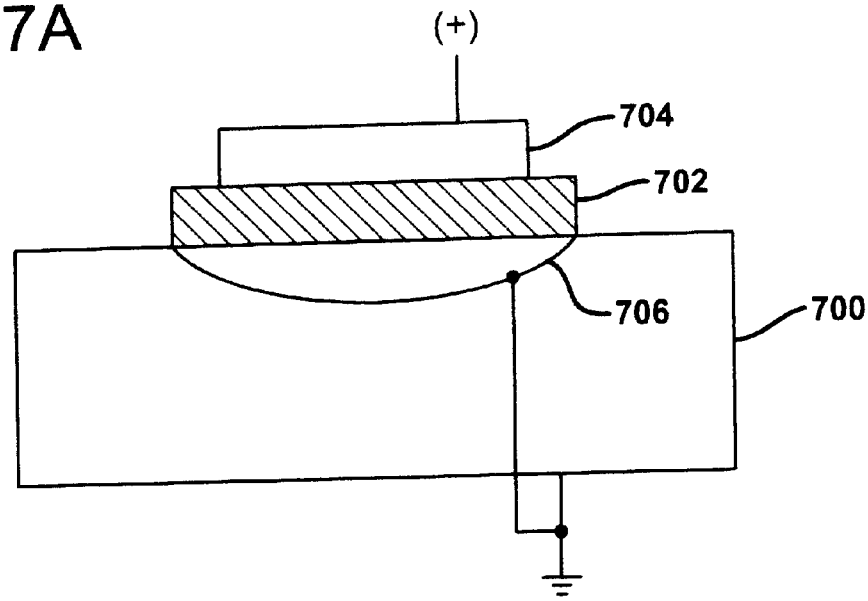
FIG. 7A is a diagrammatic view in accordance with the teachings of the present invention of a first embodiment of an individual voltage regulating capacitor.
Figure 7B:
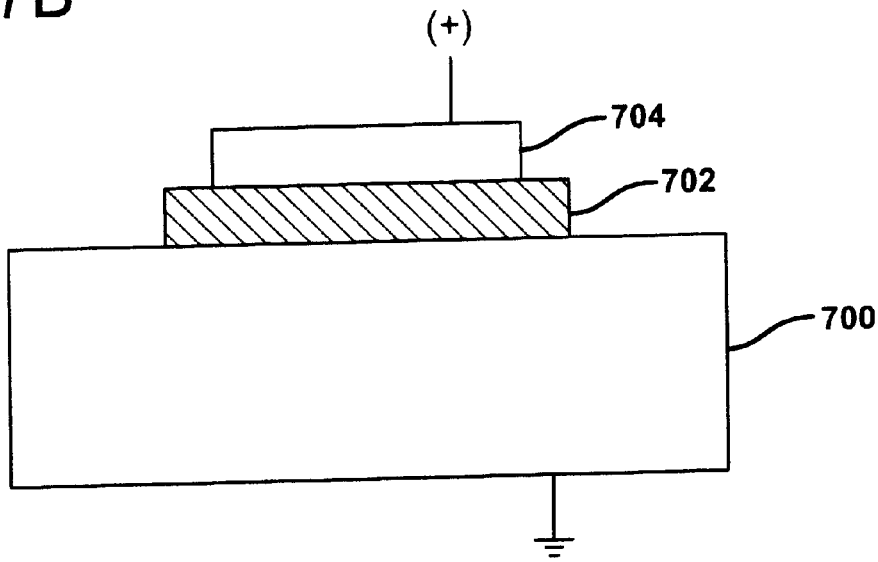
FIG. 7B is a diagrammatic view in accordance with the teachings of the present invention of a second embodiment of an individual voltage regulating capacitor.

Appreciating that the heater chip comprises a plurality of thin film layers on a semiconductor substrate, with reference to FIGS. 7A and 7B, two embodiments of capacitors C are shown. In both embodiments, a gate oxide layer 702 and a polysilicon layer 704 overlie a substrate 700. The positive capacitor electrode attaches to the polysilicon layer while the negative capacitor electrode attaches to an electrically grounded substrate. In FIG. 7A, an n-well region 706 of dopant underlies the gate oxide and is tied electrically to the grounded substrate. Appreciating the substrate is preferably a p-type, 100 orientation wafer, preferred embodiments of dopants include phosphorous and arsenic. Preferred thickness of the gate oxide is about 185 angstroms +/− about 15% and polysilicon layer is about 4500 angstroms +/− about 10%.

Those skilled in the art will appreciate that the structures depicted in FIGS. 7A and 7B, show the results of a substrate having been processed through a series of growth, deposition, masking, photolithography, and/or etching or other processing steps. As such, preferred deposition techniques include, but are not limited to, any variety of chemical vapor depositions (CVD), physical vapor depositions (PVD), epitaxy, evaporation, sputtering or other similarly known techniques. Preferred CVD techniques include low pressure (LP) ones, but could also include atmospheric pressure (AP), plasma enhanced (PE), high density plasma (HDP) or other. Preferred etching techniques include, but are not limited to, any variety of wet or dry etches, reactive ion etches, deep reactive ion etches, etc. Preferred photolithography steps include, but are not limited to, exposure to ultraviolet or x-ray light sources, or other, and photomasking includes photomasking islands and/or photomasking holes. The particular embodiment, island or hole, depends upon whether the configuration of the mask is a clear-field or dark-field mask as those terms are well understood in the art.

In a preferred embodiment, the substrate 700 includes a silicon wafer of p-type, 100 orientation, wafer having a resistivity of 5–20 ohm/cm. Its beginning thickness is preferably any one of 525+/−20 microns M1.5–89, 625+/−20 microns M1.7–89, or 625+/−15 microns M1.13–90 with respective wafer diameters of 100+/−0.50 mm, 125+/−0.50 mm, and 150+/−0.50 mm.

Finally, the foregoing description is presented for purposes of illustration and description of the various aspects of the invention. The descriptions are not intended, however, to be exhaustive or to limit the invention to the precise form disclosed. For example, the input and output voltages of the voltage regulator could be any value other than those 10, 10.8, 3.3 and 7.5 volt values described. The switch could be any switch other than a transistor or a transistor, such as npn, pnp, bi-polar transistor, n-channel, p-channel or dual channel JFET, MOSFET, IGFET, or other, instead of just the power FETs shown. The input terminals of the heater chip could comprise wires, bumps, or other instead of the bond pads shown. The drivers could embody a logic NAND with an inverter, or other, as opposed to the AND 350 shown. The inkjet printhead 10 could embody a side-shooter instead of a top-shooter. The resistive heaters could embody piezoelectric or other transducers. Accordingly, the embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A heater chip for an inkjet printhead, comprising:

an input terminal for receiving an input voltage;

a voltage regulator coupled to said input terminal having a first and second output voltage line with voltages thereon during use derived from said input voltage;

a driver coupled to one of said first and second output voltage lines for receiving powering voltage;

a control logic circuit coupled to said driver and to the other of said first and second output voltage lines for receiving power voltage;

a transistor coupled to said driver; and a resistive heater element coupled to said transistor and to said input terminal for receiving powering voltage from said input voltage.

2. The heater chip of claim 1, wherein during use one of said first and second output voltage lines is about 3.3 volts while the other of said first and second output voltage lines is about 7.5 volts.

3. The heater chip of claim 1, wherein during use said input voltage is about 10.8 volts.

4. The heater chip of claim 1, wherein said input terminal is a bond pad.

5. The heater chip of claim 1, wherein an area width of said transistor is about 400 microns.

6. A heater chip for an inkjet printhead, comprising:

a voltage regulator having an input voltage and a first and second output voltage derived from said input voltage;

a driver having an input and an output, said driver receiving powering voltage from one of said first and second output voltages;

a control logic circuit having an output coupled to said input of said driver, said control logic circuit receiving powering voltage from the other of said first and second output voltages;

a transistor having a gate, a source and a drain, said gate coupled to said output of said driver; and a resistive heater element coupled to said drain and operable to heat upon activation of said transistor, said resistive heater element receiving powering voltage from said input voltage.

7. The heater chip of claim 6, wherein said transistor has an area width of about 400 microns.

8. A heater chip for an inkjet printhead, comprising:

a bond pad for receiving an input voltage of about 10.8 volts;

a voltage regulator electrically coupled to said bond pad having a first and second output voltage line with first and second output voltages thereon during use derived from said input voltage, said first output voltage being about 3.3 volts and said second output voltage being about 7.5 volts;

a plurality of drivers each having a plurality of inputs and an output, said plurality of drivers receiving powering voltage from said second output voltage line;

a control logic circuit having a plurality of outputs coupled to said plurality of inputs of said each driver, said control logic circuit receiving powering voltage from said first output voltage line;

a plurality of transistors each having an area width of about 400 microns and a gate, a source and a drain, each said gate coupled to said output of said each driver; and a plurality of resistive heater elements each coupled between one of said drains and said input voltage.

9. A heater chip for an inkjet printhead, comprising:

a voltage regulator having at least two output voltage lines;

a driver coupled to receive powering voltage from one of said output voltage lines; and a FET having a gate coupled to said driver, said FET having an area width of about 400 microns.

10. The heater chip of claim 9, wherein said FET receives an output signal from said driver such that a Vgs of said FET is about 7.5 volts.

11. The heater chip of claim 9, further including an input voltage line coupled to said voltage regulator.

12. The heater chip of claim 11, further including a resistive heater element coupled to a drain of said FET and to said input voltage line.

13. A heater chip for an inkjet printhead, comprising:

an input voltage line;

a voltage regulator coupled to said input voltage line, said voltage regulator having at least two output voltage lines;

a driver coupled to receive powering voltage from one of said output voltage lines;

a switch coupled to said driver; and a resistive heater element coupled to both said switch and said input voltage line.

14. The heater chip of claim 13, further including a logic control circuit coupled to said driver and to the other of said output voltage lines for receiving powering voltage.

15. The heater chip of claim 13 having a plurality of capacitors in parallel with each of said at least two output voltage lines.

16. An inkjet printhead, comprising:

a supply of ink;

a plurality of I/O connectors; and a heater chip electrically connected to said plurality of I/O connectors, said heater chip having a voltage regulator coupled to one of said plurality of I/O connectors for receiving an input voltage and having a first and second output voltage line;

a driver coupled to receive powering voltage from one of said first and second output voltage lines;

a control logic circuit coupled to said driver, said control logic circuit coupled to receive powering voltage from the other of said first and second output voltage lines;

a switch coupled to said driver; and a resistive heater element coupled to both said switch and said one of said plurality of I/O connectors to eject an ink drop from said supply of ink upon activation of said switch.

17. An inkjet printer containing the inkjet printhead of claim 16.

18. The inkjet printer of claim 17, wherein only one source of voltage couples to said plurality of I/O connectors.

19. The inkjet printhead of claim 16, wherein the heater chip further includes a plurality of bond pads coupled to said plurality of I/O connectors.

20. The inkjet printhead of claim 16, further including a TAB circuit for supporting the I/O connectors.

21. A method of operating a heater chip of an inkjet printhead, comprising:

supplying an input voltage to a voltage regulator;

deriving at least a first and second output voltage from said input voltage, said deriving being done by said voltage regulator;

supplying one of said first and second output voltage to a driver;

activating a switch coupled to said driver by an output of said driver; and supplying said input voltage to a resistive heater element coupled to an output of said switch.

22. The method of claim 21, further including supplying the other of said first and second output voltage to a control logic circuit having an output coupled to said driver.

23. The method of claim 21, wherein the switch is a FET and wherein the activating the switch further includes supplying said output of said driver such that a Vgs of the FET is about 7.5 volts.

24. The method of claim 21, wherein the deriving the at least first and second output voltage further includes generating a first voltage of about 3.3 volts and a second voltage of about 7.5 volts.

25. The method of claim 21, wherein the supplying the input voltage further includes supplying a voltage of about 10.8 volts from an inkjet printer.

26. A method of operating a heater chip of an inkjet printhead, comprising:

supplying an input voltage to a voltage regulator;

deriving at least a first and second output voltage from said input voltage, said deriving being done by said voltage regulator;

supplying one of said first and second output voltage to a driver;

supplying the other of said first and second output voltage to a control logic circuit having an output coupled to an input of said driver;

activating a transistor coupled to said driver by an output of said driver;

supplying said input voltage to a resistive heater element coupled to an output of said switch;

heating said resistive heater element; and ejecting ink from the printhead.

27. A heater chip for an inkjet printhead, comprising:

an input voltage line;

a voltage regulator having a first and second output voltage line; and at least one capacitor in parallel with said input voltage line and said first and second output voltage line, said at least one capacitor including a substrate;

a gate oxide layer on said substrate; and a polysilicon layer on said gate oxide layer.

28. The heater chip of claim 27, wherein said substrate has a well of n-type dopant beneath said gate oxide layer.

29. The heater chip of claim 28, wherein the dopant is one of phosphorous and arsenic.

* * * * *